United States Patent [19]

Fisler

[11] 4,241,294

[45] Dec. 23, 1980

[54] BRIGHTNESS CONTROL CIRCUIT FOR A VACUUM FLUORESCENT DISPLAY

[75] Inventor: Charles F. Fisler, New Hartford, N.Y.

[73] Assignee: General Electric Company, New York, N.Y.

[21] Appl. No.: 41,544

[22] Filed: May 23, 1979

[51] Int. Cl.[3] ..... H05B 37/02; H05B 41/39; G05F 1/00

[52] U.S. Cl. ..... 315/291; 315/169.1; 340/767

[58] Field of Search ..... 315/291, 169.1; 340/767, 775, 760

[56] References Cited

U.S. PATENT DOCUMENTS

| | | | |
|---|---|---|---|
| 4,158,794 | 6/1979 | Sandler | 315/169.1 |
| 4,190,189 | 5/1978 | Fisler | 315/169.1 |

*Primary Examiner*—Alfred E. Smith
*Assistant Examiner*—Thomas P. O'Hare
*Attorney, Agent, or Firm*—Carlos Nieves; P. L. Schlamp; Joseph B. Forman

[57] ABSTRACT

A circuit for controlling the brightness of a vacuum fluorescent display having filament terminals and connected to anode or segment biasing means includes a transformer having a filament winding connected to the filament terminals. The transformer is driven by a 60-cycle power source. An electronic switch, including a transistor, is connected between a center tap of the filament and the anode biasing means (at a common ground) and circuit means open and close the switch at a 60-cycle rate. The ratio of time during which the switch is closed to the time during which the switch is open is variable to control the brightness of the display.

10 Claims, 8 Drawing Figures

2a.
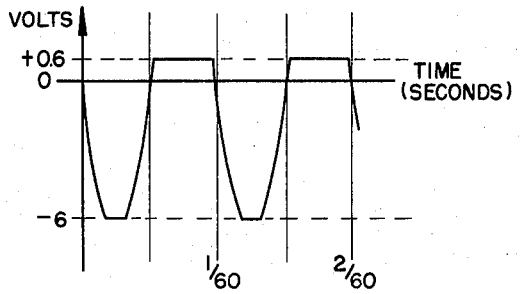
2b.
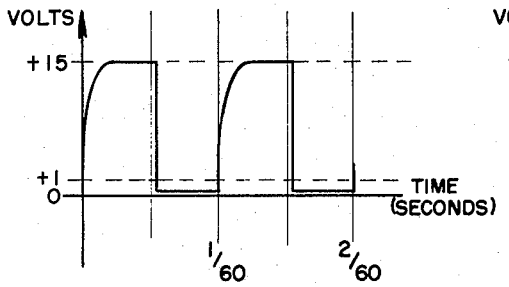
2c.
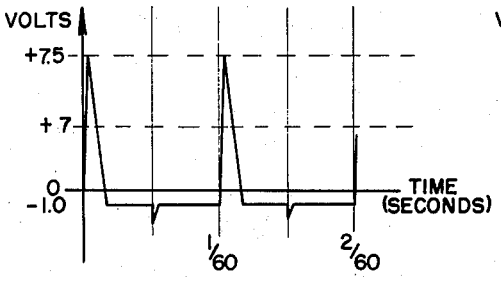
2d.
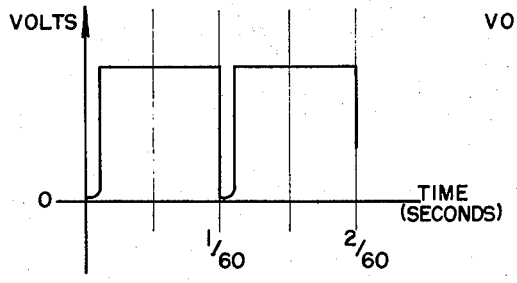
2e.
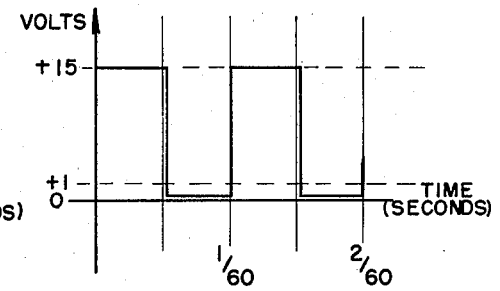
2f.
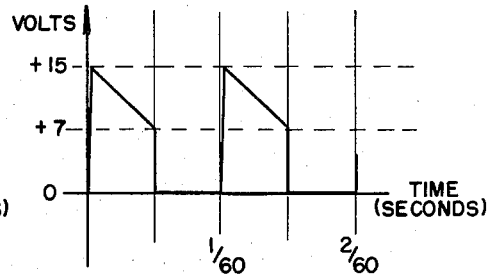
2g.
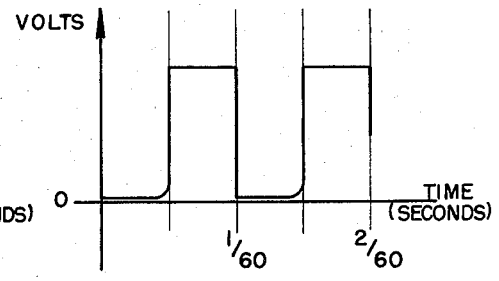

BRIGHTNESS CONTROL CIRCUIT FOR A VACUUM FLUORESCENT DISPLAY

BACKGROUND OF THE INVENTION

1. FIELD OF THE INVENTION

The subject invention relates to electronic displays and to control circuitry for controlling the light output of these displays.

2. DESCRIPTION OF PRIOR ART

In the more common type of brightness control circuit for electronic displays, the current supplied to the display elements is controlled as a function of the amount of illumination desired from the display. This is normally done by adjusting a resistance through which the energizing current flows, or by adjusting the supply voltage as applied through an emitter follower circuit. In addition to being inefficient and wasteful of energy, these forms of control have a limited range over which the illumination can be uniformly controlled and tends to turn off completely at low brightness levels. As a related matter, the control circuit may be subject to temperature instabilities and excessive variations in component tolerances, giving rise to a nonuniform illumination from the display elements.

In addition to the foregoing, the public is aware of U.S. Pat. No. 4,090,189. This patent discloses a brightness control circuit for controlling the current flow from a source of energizing potential to an L.E.D. electronic display, the output of said potential source being coupled through a transistor switching means for supplying pulses of approximately constant peak current to the display elements. The transistor switching means is controlled so as to provide a periodic on/off operation having a duty cycle that is varied to control the brightness of the display. The operation of the transistor switching means is controlled as a function of a drive signal of approximately constant peak voltage derived from a capacitive charge-discharge circuit. This circuit includes a capacitor that is charged through a serially connected charge circuit means which includes a brightness control resistor whose resistance is adjusted for a selected condition of brightness to determine the initial rate of charge of said capacitor voltage, the capacitor being periodically and briefly discharged through a discharge transistor. During the charge time the capacitor voltage is made to exceed a given threshold voltage Vth, and during discharge the capacitor voltage is reduced toward a reference level that is below Vth. A threshold voltage sensing transistor having its input coupled to the capacitor through a resistor voltage divider circuit and its output coupled to the input of the transistor switching means responds to the voltage across the capacitor and derives at its output a drive signal having a duty cycle that is dependent upon the relative time said capacitor voltage is above and below Vth. Thus, the threshold voltage sensing transistor provides the transistor switching means with a precise on/off operation.

SUMMARY OF THE INVENTION

It is an object of the invention to provide an improved brightness control circuit for vacuum fluorescent displays that provides a continuous control of the display elements over a wide range of brightness levels, extending particularly into the low brightness region.

Another object of the invention is to provide a brightness control circuit that provides uniform illumination from the display elements over a wide range of brightness levels.

A further object of the invention is to provide a brightness control circuit which is of relatively simple circuit configuration and may be constructed inexpensively.

Another object of the invention is to provide a brightness control circuit that is highly reproducible on a mass production basis.

The invention herein may be described broadly as a circuit for controlling the brightness of a vacuum fluorescent display having filament terminals and connected to anode biasing means. The circuit comprises: (a) a source of power electrically connected to the filament terminals of the display; (b) an electronic switch connected between the source and the anode biasing means; and (c) means for periodically opening and closing the switch, the ratio of time during which the switch is closed to the time during which the switch is open being variable to control the brightness of the display.

A feature of the invention resides in that the circuit may be used to provide low brightness levels in a vacuum fluorescent display without sacrificing segment to segment uniformity in brightness.

BRIEF DESCRIPTION OF THE DRAWING

The above-mentioned and other objects and features of the invention will become apparent by reference to the following description in conjunction with the accompanying drawing, in which:

FIG. 2*a* being related to the base of an input transistor of the circuit;

FIG. 2*b* being related to the collector of the input transistor when the circuit is set to operate in a minimum brightness mode;

FIG. 2*c* being related to a circuit junction when the circuit is set to operate in a minimum brightness mode;

FIG. 2*d* being related to the collector to ground voltage across an output switching transistor when the circuit is set to operate in a minimum brightness mode;

FIG. 2*e* being related to the collector of the input transistor when the circuit is set to operate in a maximum brightness mode;

FIG. 2*f* being related to said circuit junction when the circuit is set to operate in a maximum brightness mode; and FIG. 2*g* being related to the collector to ground voltage across the switching transistor when the circuit is set to operate in a maximum brightness mode.

DESCRIPTION OF A PREFERRED EMBODIMENT

Figure 1:
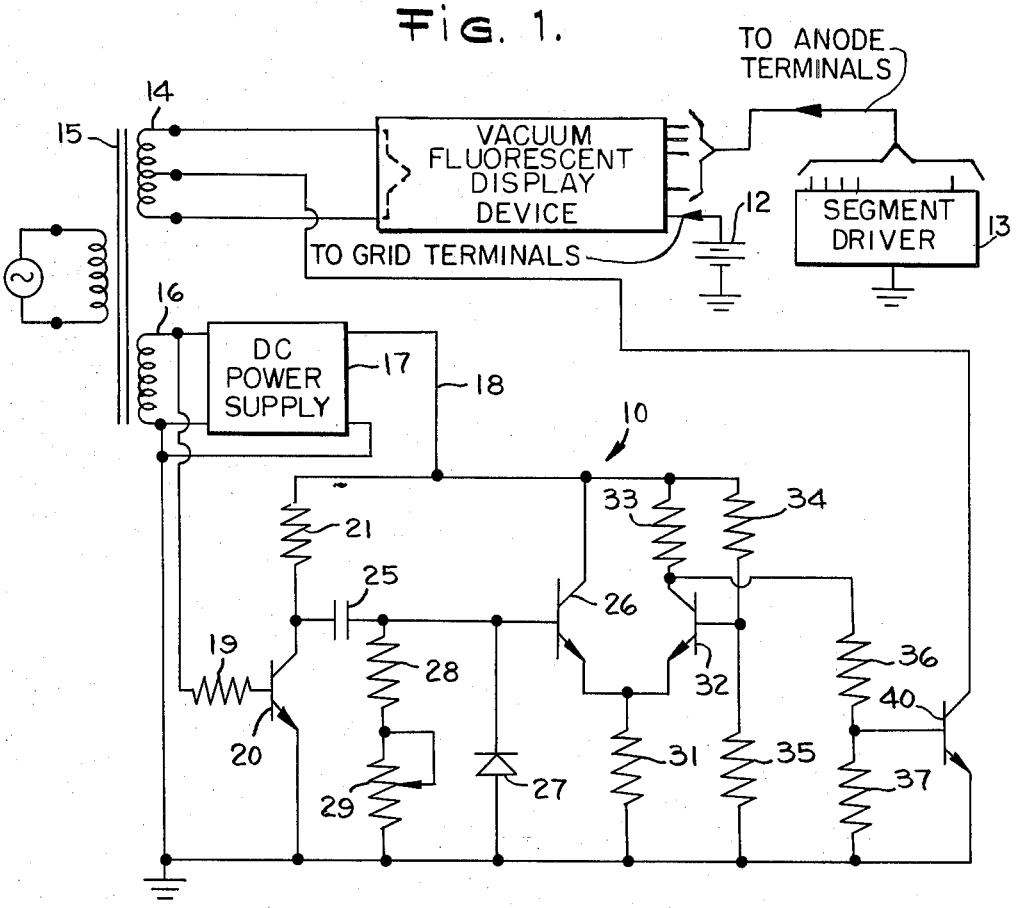
FIG. 1 is a schematic circuit diagram of a brightness control circuit, according to the invention, for controlling the illumination of a vacuum fluorescent display; and, FIGS. 2*a–g* represent waveforms as they appear at various points in said control circuit.

Referring to FIG. 1, a circuit 10, according to the invention, is shown connected to the filament terminals of a vacuum fluorescent display device 11. Device 11 is available from Nippon Electric Company and is presently sold under the designation 5-LT-16. As is typical, the grid of device 11 is biased with a suitably grounded DC power supply 12 and the anodes or segments of the device are biased, selectively, by a segment driver 13 having a DC power supply (not shown) with a grounded terminal, and an electronic clock circuit (not shown) such as is sold by Toko under part number 50366. As persons skilled in the display art are undoubtedly aware, the number of independently driven anode segments in a display determines the number of wires which couple the display to a segment driver and, in this sense, the wires drawn between display 11 and driver 13 are only representative. A manufactured circuit described hereafter will include a more specific description of appropriate interconnections. The filament of display device 11 requires three volts AC and, therefore, is connected to a filament winding 14 of a transformer 15. Transformer 15 is driven by a 115-volt, 60-cycle per second power source and, in this example, is used to supply power to the circuit 10. Filament winding 14 includes a center tap which in prior art arrangements is connected directly to ground to provide a return path for currents flowing from DC bias supplies connected to the grid and segments of the display device. However, according to the present invention, the center tap of the filament winding is coupled to ground by an electronic switch which is periodically opened and closed, the ratio of time during which the switch is closed to the time during which the switch is open being variable to control the brightness of the display. In the present embodiment, the electronic switch includes a semiconductor device, i.e., transistor 40, which is driven into and out of conduction to perform the switching function described above.

Transformer 15 includes an output winding 16 which is grounded at one end and which is connected to input terminals of a power supply 17. Power supply 17 supplies fifteen volts DC to line 18 which is used to power the circuitry which controls the switching of transistor 40.

The ungrounded end of the output winding 16 is coupled by a series resistor 19 to the base of an NPN transistor 20. The emitter of transistor 20 is connected to ground and its collector is coupled by a load resistor 21, via line 18, to the power supply. Resistor 19 is a voltage dropping resistor which is used to bias transistor 20. During operation, transistor 20 is driven on by positive voltage on the winding 16 and off when the output voltage on winding 16 becomes negative. Referring to FIG. 2*a*, the sinusoidal voltage provided by winding 16 results in the appearance at the base of transistor 20 of a clipped sinusoidal voltage, the maximum positive voltage being limited to about 0.6 volts and the maximum negative voltage being limited to about 6 volts by the emitter to base junction characteristics of transistor 20. As shown by FIG. 2*b*, when transistor 20 is fully on its collector to emitter voltage is several tenths of a volt and when transistor 20 is off its collector to emitter voltage is approximately the same as the voltage on line 18. The collector of transistor 20 is also connected to a capacitor 25 whose other terminal is connected to the base of an NPN transistor 26, to the cathode of a diode 27, and to one end of a resistor 28. The anode of diode 27 is connected to ground and the other end of resistor 28 is coupled to ground by a series-connected variable resistor 29. The collector of transistor 26 is also connected to the emitter of a similar NPN transistor 32. Transistor 32 has its collector coupled to line 18 by a resistor 33 and its base is connected to a voltage divider connected between line 18 and ground. The voltage divider includes a resistor 34 which couples the base of transistor 32 to power supply line 18 and a resistor 35, having a similar value, which couples said base to ground. As a result, resistors 34 and 35 apply a reference voltage of about 7 volts to the base of transistor 32. From the foregoing, it should be recognized that transistors 26 and 32 are arranged to provide an emitter-coupled differential amplifier of the type wherein, when the voltage at the base of transistor 26 is less than the reference voltage at the base of transistor 32, transistor 32 will be on and transistor 26 will be off. On the other hand, if the voltage at the base of transistor 26 is greater than the reference voltage at the base of transistor 32, transistor 32 will be off while transistor 26 will be on. The collector of transistor 32 is connected by a voltage divider including resistors 36 and 37 to the base of transistor 40. Resistors 36 and 37 are selected so as to turn transistor 40 on when transistor 32 is off and off when transistor 32 is on. From the foregoing, it will be appreciated that the on and off times of transistor 40 are determined by the voltage applied to the base of transistor 26. More particularly, when the voltage at the base of transistor 26 is greater than the reference voltage at the base of transistor 32, transistor 40 conducts and the DC circuit path for the display device 11 is completed. Alternatively, if the voltage at the base of transistor 26 is less than the reference voltage, transistor 15 is biased into a non-conductive state, whereby the DC circuit path for the device 11 is interrupted. As will appear, the voltage at the base of transistor 26 periodically exceeds and is less than the reference voltage applied at the base of transistor 32.

Referring to FIG. 1, if it is assumed that transistor 20 is fully on, as is the case when the voltage supplied by winding 16 is positive, the voltage across capacitor 25 is substantially zero. Subsequently, when the voltage on winding 16 goes negative (see FIG. 2*a*) transistor 20 turns off and the voltage at the collector of transistor 20 rises rapidly towards the fifteen volts available on line 18 (see FIG. 2*b*). The voltage across the capacitor cannot change instantaneously and, therefore, for a brief period seven and one-half volts is applied to the base of transistor 26. With transistor 20 off, capacitor 25 charges through resistors 21, 28 and variable resistor 29. Referring to FIG. 2*c* which is a waveform representing the voltage at the base of transistor 26, as the voltage rises to the seven and one-half volt level, it exceeds the reference voltage at the base of transistor 32 and turns on transistor 26. As capacitor 25 charges towards the fifteen-volt level on line 18, the voltage at the base of transistor 26 drops below the reference voltage and turns off. When the voltage on winding 16 returns to positive values in the next cycle, transistor 20 is turned on and capacitor 25 discharges through diode 27 and the transistor 20. During this period of time, transistor 26 is in an off state. Transistors 26 and 40 are on and off at about the same time and, therefore, transistor 40 is off more than fifty percent of the time. Referring to FIG. 2*d*, which represents the collector to emitter voltage of transistor 40, it may be noted that transistor 40 conducts during periods of time when the voltage at the base of transistor 26 is greater than the reference voltage and that this time is related to the set value of the variable resistor 29. The waveforms in FIGS. 2*e*–*g* represent the voltages which appear at the collector of transistor 20, the base of transistor 26 and the collector to emitter voltage of transistor 40, respectively. A close inspection of FIG. 2*f* reveals that the voltage at the base of transistor 26 is just about above the value of the reference voltage when the transistor 20 is turned on by a positive voltage from winding 16. Therefore, a further increase in the set value of the variable resistor will not affect the conduction times of transistor 40. Accordingly, FIGS. 2*e–g* are related to a maximum brightness mode of operation for device 11.

A circuit such as described and shown in FIG. 1 may be manufactured with the following components and/or circuit values.

| | |
|---|---|
| TRANSISTORS | |
| 20, 26, 32, 40 | Type 2N3414 |
| DIODE | |
| 27 | Type 1N461 |
| RESISTORS | |
| 19 | 20K ohm |
| 21 | 10K ohm |
| 28 | 10K ohm |
| 29 | 0–250K ohm |
| 31 | 5.1K ohm |
| 33 | 6.2K ohm |
| 34, 35 | 18K ohm |
| 36 | 39K ohm |
| 37 | 2K ohm |
| CAPACITOR | |
| 25 | 0.1 mf |

The fluorescent display device sold by Nippon Electric Company under part number 5-LT-16 is a clock display and includes anode segments for four decimal characters related to minutes, 10's of minutes, hours and 10's of hours. In manufacturing the circuit of FIG. 1 filament terminals 1 and 33 (not referenced) of the display are each connected to one of the ends of winding 14 and grid terminal 5 (not referenced) of the display is connected to the power supply 12. Other terminals of the display are connected to the segment drive sold by Toko under part number 60366 in accordance with the following tabulation, wherein the customary seven segment character letter designations are used:

| Display Element | Display Terminal | Drive Terminal |
|---|---|---|
| 10's hrs. | 10 | 37 |
| hrs. F anode | 11 | 39 |
| hrs. G. anode | 12 | 1 |
| hrs. A anode | 13 | 3 |
| hrs. B anode | 14 | 4 |
| hrs. D anode | 15 | 7 |
| hrs. C anode | 16 | 6 |
| hrs. E anode | 17 | 2 |
| 10 min. F anode | 19 | 8 |
| 10 min. G. anode | 20 | 9 |
| 10 min. A and D anode | 21 | 13 |
| 10 min. B anode | 22 | 11 |
| 10 min. E anode | 23 | 10 |
| 10 min. C anode | 24 | 12 |
| min. F anode | 25 | 14 |
| min. G anode | 26 | 15 |
| min. A anode | 27 | 17 |
| min. B. anode | 28 | 18 |
| min. E anode | 29 | 16 |
| min. C anode | 31 | 19 |
| min. D anode | 32 | 20 |

In manufacturing a brightness control device, according to the foregoing description, it should be noted that power supply 12 and the power supply of driver 13 need not be independent and, in fact, the device and driver can be powered by a DC voltage provided by power supply 17.

Electronic circuit designers can modify the disclosed circuit in other ways. Therefore, it is to be understood that the description herein of a device embodying the invention has been set forth as an example thereof and is not to be construed or interpreted to provide limitations on the claims which follow and define the invention.

I claim:

1. A circuit for controlling the brightness of a vacuum fluorescent display having filament terminals and connected to anode biasing means, comprising:

(a) a source of power electrically connected to the filament terminals of the display;

(b) an electronic switch connected between the source and the anode biasing means; and (c) means for periodically opening and closing the switch, the ratio of time during which the switch is closed to the time during which the switch is open being variable to control the brightness of the display.

2. A circuit as defined in claim 1 wherein said source of power includes an AC source of power and a transformer having a filament winding, the winding being connected to the filament terminals and wherein the connection between the switch and source is a connection of the switch to a tap located between the ends of the filament winding.

3. A circuit as defined in claim 2 wherein the electronic switch includes a semiconductor device.

4. A circuit as defined in claim 2 wherein said means for periodically opening and closing the switch are coupled to an output winding of the transformer, whereby the periodic opening and closing of the switch occurs with a frequency related to the frequency of the AC source of power.

5. A circuit as defined in claim 2 wherein said means for periodically opening and closing the switch includes: a DC power supply; a resistance connected in series with a capacitor; means coupled to an output winding of the transformer to charge the capacitor from the DC supply and, alternately, discharge the capacitor; and means responsive to a voltage developed across said resistance during charging and discharging of said capacitor for opening and closing the electronic switch.

6. A circuit as defined in claim 5 wherein the input terminals of the DC power supply are connected to the output winding of the transformer.

7. A circuit as defined in claim 5 wherein said switch includes a transistor whose collector is connected to the tap and whose emitter is connected to the anode biasing means; and wherein said means responsive to a voltage developed across said resistance opens and closes the electronic switch by biasing the transistor off and on, respectively.

8. A circuit as defined in claim 7 wherein said means responsive to a voltage developed across said resistance includes means for establishing a reference voltage and means responsive to the reference voltage and the developed voltage to drive the transistor on or off.

9. A circuit as defined in claim 8 wherein said resistance includes a first branch having a diode and a second branch including a variable resistor, the branches being in parallel with each other and in series with said capacitor to control the charge and discharge rate of said capacitor, whereby variation of the resistor varies the ratio of time during which the transistor is on to the time during which the transistor is off.

10. A circuit as defined in claim 9 wherein the input terminals of the DC power supply are connected to the output winding of the transformer.

* * * * *